US008348012B2

(12) United States Patent
Hwang

(10) Patent No.: US 8,348,012 B2
(45) Date of Patent: Jan. 8, 2013

(54) RESONATOR

(75) Inventor: Ho Jun Hwang, Anyang-si (KR)

(73) Assignee: LS Mtron Ltd., Anyang-si, Gyeonggi-do (KR)

( * ) Notice: Subject to any disclaimer, the term of this patent is extended or adjusted under 35 U.S.C. 154(b) by 0 days.

(21) Appl. No.: 13/194,444

(22) Filed: Jul. 29, 2011

(65) Prior Publication Data

US 2012/0181107 A1 Jul. 19, 2012

(30) Foreign Application Priority Data

Jan. 13, 2011 (KR) ..... 10-2011-0003490

(51) Int. Cl.
*F02M 35/00* (2006.01)

(52) U.S. Cl. ..... 181/229; 181/212; 123/184.54; 123/184.53; 123/184.55; 123/184.56; 123/184.57

(58) Field of Classification Search ..... 181/229; 123/184.53, 184.54, 184.55, 184.56, 184.57
See application file for complete search history.

(56) References Cited

U.S. PATENT DOCUMENTS

| | | | | |
|---|---|---|---|---|
| 5,647,314 | A * | 7/1997 | Matsumura et al. | 123/184.57 |
| 5,929,397 | A * | 7/1999 | Satoh et al. | 181/229 |
| 6,009,705 | A * | 1/2000 | Arnott et al. | 60/312 |
| 6,230,677 | B1 * | 5/2001 | Setsuda | 123/184.21 |
| 6,386,317 | B1 * | 5/2002 | Morohoshi et al. | 181/252 |
| 7,089,901 | B2 * | 8/2006 | Kino et al. | 123/184.57 |
| 7,198,017 | B2 * | 4/2007 | Vogt et al. | 123/184.57 |
| 7,690,478 | B2 * | 4/2010 | Kostun et al. | 181/250 |
| 7,967,106 | B2 * | 6/2011 | Ross et al. | 181/229 |

FOREIGN PATENT DOCUMENTS

| | | | |
|---|---|---|---|
| JP | 02215925 | A * | 8/1990 |
| KR | 20-1998-033640 | | 9/1998 |
| KR | 10-1999-0049960 | | 7/1999 |
| KR | 10-2009-0047083 | | 5/2009 |

* cited by examiner

*Primary Examiner* — Forrest M Phillips
(74) *Attorney, Agent, or Firm* — Sherr & Jiang, PLLC

(57) ABSTRACT

The present disclosure relates to a resonator, and more particularly, to a resonator installed at the rear of a turbo charger of a vehicle and combined with a Helmholtz resonator and a groove type resonator to attenuate both high-frequency noise and low-frequency noise. The resonator installed at the rear of a turbo charger of a vehicle to attenuate an inhaling noise includes: at least one Helmholtz resonator having a cavity in an air introduction path extending into a duct so that the cavity is formed in a radial direction of the duct; and at least one groove type resonator provided at the rear of the Helmholtz resonator and protruding outwards in the radial direction of the duct.

3 Claims, 2 Drawing Sheets

RESONATOR

CROSS-REFERENCE TO RELATED APPLICATION

This application claims priority to Korean Patent Application No. 10-2011-0003490, filed on Jan. 13, 2011, and all the benefits accruing therefrom under 35 U.S.C. §119, the contents of which in its entirety are herein incorporated by reference.

BACKGROUND

1. Field

The present disclosure relates to a resonator, and more particularly, to a resonator installed at the rear of a turbo charger of a vehicle and combined with a Helmholtz resonator and a groove type resonator to attenuate both high-frequency noise and low-frequency noise.

2. Description of the Related Art

An inhaling system of a vehicle for the combustion of a fuel introduces air into an engine while subsequently passing through a snorkel, a first resonator, an air filter, a turbo charger, a second resonator, an intercooler, a duct and an engine manifold.

While air is inhaled, there are generated a pulsation noise which is a noise of fluid caused by opening or closing an inhaling or exhausting valve and an air current noise which is a noise of turbulence caused by the vortex or collision when a high-speed exhaust gas current passes through a silencer.

Noise is a sound in an audible frequency (16 Hz to 20 kHz) which is sensuously not desired by persons, among sonic waves generated by vibration of the air. The sonic wave is generated by very small displacement of each air particle which repeatedly vibrates in an equivalent location like a pendulum.

For ensuring convenient feeling of a driver and safe driving, it is necessary to reduce the noise. The first resonator and the second resonator are used for reducing noise.

A Helmholtz resonator is widely used for reducing sound. The Helmholtz resonator includes a neck and a resonance chamber with a predetermined capacity. The Helmholtz resonator is attached to a certain duct to decrease a sound with a specific inherent frequency.

As techniques using the Helmholtz resonator, Korean Patent Publication No. 1999-0049960 discloses a volume-variable Helmholtz resonator, and Korean Patent Publication No. 2009-0047083 discloses a series Helmholtz resonator. These techniques however have a limit in that only a noise within a limited frequency band can be attenuated.

In addition, Korean Utility Model Publication No. 1998-033640 discloses that an interfering silencer for attenuating a high-frequency noise is provided at the front of a resonator for attenuating a low-frequency noise in order to attenuate both of the low-frequency and high-frequency noises.

However, this structure is suitable for the first resonator which is installed at the rear of the snorkel, and the interfering silencer has an interfering range of 3 kHz or below. In addition, the interfering principle is a ½ or ¼ wavelength duct principle (length-change principle). Here, if the frequency of the noise range increases further, the interfering silencer may not be used appropriately, and therefore this structure is not suitable for the second resonator into which air is rapidly introduced by the turbo charger. Further, the inner structure of the interfering silencer has a lattice plate and a chamber, its volume becomes great.

SUMMARY

The present disclosure is directed to providing a resonator which may be installed at the rear of a turbo charger to attenuate noise in both low-frequency and high-frequency bands.

In one aspect, there is provided a resonator installed at the rear of a turbo charger of a vehicle to attenuate an inhaling noise, which includes: at least one Helmholtz resonator having a cavity in an air introduction path extending into a duct so that the cavity is formed in a radial direction of the duct; and at least one groove type resonator provided at the rear of the Helmholtz resonator and protruding outwards in the radial direction of the duct.

The Helmholtz resonator may have a front portion and a rear portion based on the cavity, and the length of the front portion may be smaller than the length of the rear portion.

The groove type resonator may include a first groove type resonator and a second groove type resonator subsequently formed along the air introduction path, where the width of the first groove type resonator may be smaller than that of the second groove type resonator and the height of the first groove type resonator may be greater than that of the second groove type resonator.

BRIEF DESCRIPTION OF THE DRAWINGS

The above and other aspects, features and advantages of the disclosed exemplary embodiments will be more apparent from the following detailed description taken in conjunction with the accompanying drawings in which.

DETAILED DESCRIPTION

Figure 1:
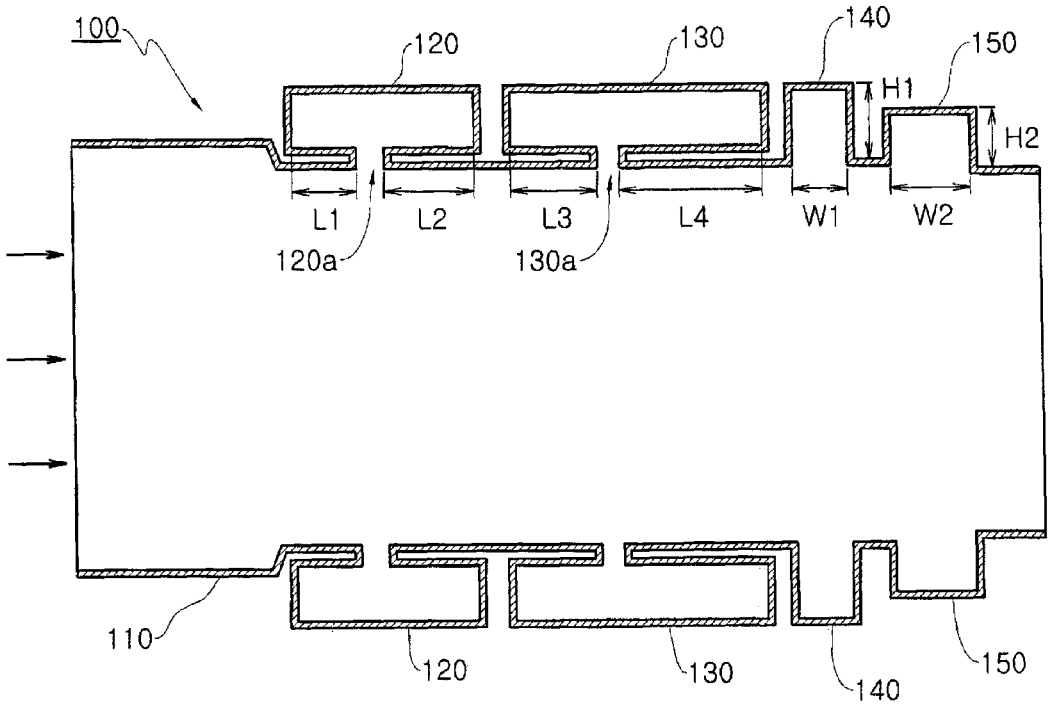
FIG. 1 is a sectional view schematically showing a resonator according to an exemplary embodiment disclosed herein.

Exemplary embodiments now will be described more fully hereinafter with reference to the accompanying drawings, in which exemplary embodiments are shown. The present disclosure may, however, be embodied in many different forms and should not be construed as limited to the exemplary embodiments set forth therein. Rather, these exemplary embodiments are provided so that the present disclosure will be thorough and complete, and will fully convey the scope of the present disclosure to those skilled in the art. In the description, details of well-known features and techniques may be omitted to avoid unnecessarily obscuring the presented embodiments.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second", and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals denote like elements. The shape, size and regions, and the like, of the drawing may be exaggerated for clarity.

FIG. 1 is a sectional view schematically showing a resonator according to an exemplary embodiment disclosed herein.

Referring to FIG. 1, the resonator 100 of this embodiment is installed at the rear of a turbo charger of a vehicle to attenuate an inhaling noise and includes at least one Helmholtz resonator 120 and 130 and at least one groove type resonator 140 and 150. In FIG. 1, two Helmholtz resonators 120 and 130 and two groove type resonators 140 and 150 are provided in parallel, but more Helmholtz resonators and more groove type resonators may be added in correspondence with a frequency band to be attenuated.

The Helmholtz resonator 120 and 130 has a cavity 120*a* and 130*a* in an air introduction path which extends into a duct 110, so that the cavity 120*a* and 130*a* is formed in a radial direction of the duct 110. The air flowing in the duct is partially introduced into the Helmholtz resonator 120 and 130 through the cavity 120*a* and 130*a* to cause resonance. The Helmholtz resonator 120 and 130 of this embodiment generally attenuates a noise within 2 kHz to 5 kHz low-frequency band.

In addition, the Helmholtz resonator 120 and 130 may have a front portion and a rear portion based on the cavity 120*a* and 130*a* so that the length L1 and L3 of the front portion is smaller than the length L2 and L4 of the rear portion.

The groove type resonator 140 and 150 is provided at the rear of the Helmholtz resonator 120 and 130 and protrudes outwards in the radial direction of the duct 110. The groove type resonator 140 and 150 includes a first groove type resonator 140 and a second groove type resonator 150 which are subsequently formed along the air introduction path. The width W1 of the first groove type resonator 140 may be smaller than the width W2 of the second groove type resonator 150, and the height H1 of the first groove type resonator 140 may be greater than the height H2 of the second groove type resonator 150. In other words, the groove type resonator 140 and 150 causes resonance by increasing and decreasing a duct which changes a sectional area, thereby generally attenuating a noise in a high-frequency band of 7 kHz to 11 kHz.

Figure 2:
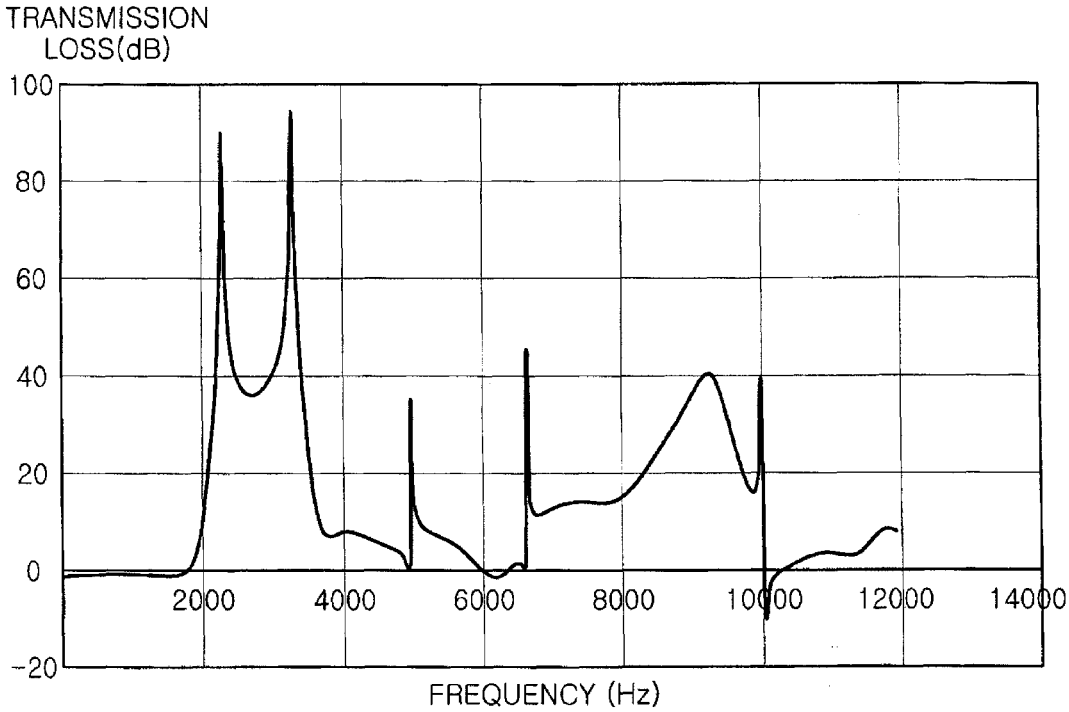
FIG. 2 is a graph illustrating a transmission loss of a noise according to a frequency band by applying the resonator of the exemplary embodiment.

FIG. 2 is a graph showing a transmission loss of a noise according to a frequency band by applying the resonator according to the exemplary embodiment.

Referring to FIG. 2, it could be found that the noise in a low-frequency band of 2 kHz to 5 kHz and the noise in a high-frequency band of 7 kHz to 11 kHz has great transmission losses. In other words, the resonator 100 disclosed herein may attenuate both of the low-frequency noise and the high-frequency noise by using the Helmholtz resonator 120 and 130 and the groove type resonator 140 and 150 in parallel.

The resonator according to this disclosure may attenuate noise in both low-frequency and high-frequency bands by combining a Helmholtz resonator and a groove type resonator.

While the exemplary embodiments have been shown and described, it will be understood by those skilled in the art that various changes in form and details may be made thereto without departing from the spirit and scope of the present disclosure as defined by the appended claims.

In addition, many modifications can be made to adapt a particular situation or material to the teachings of the present disclosure without departing from the essential scope thereof. Therefore, it is intended that the present disclosure not be limited to the particular exemplary embodiments disclosed as the best mode contemplated for carrying out the present disclosure, but that the present disclosure will include all embodiments falling within the scope of the appended claims.

What is claimed is:

1. A resonator installed at the rear of a turbo charger of a vehicle to attenuate an inhaling noise, the resonator comprising:

at least one Helmholtz resonator having a cavity in an air introduction path extending into a duct so that the cavity is formed in a radial direction of the duct; and at least one groove type resonator provided at the rear of the Helmholtz resonator and protruding outwards in the radial direction of the duct, wherein the at least one groove type resonator is spaced apart from the at least one Helmholtz resonator along a longitudinal direction of the duct.

2. The resonator according to claim 1, wherein the Helmholtz resonator has a front portion and a rear portion based on the cavity, and the length of the front portion is smaller than the length of the rear portion.

3. The resonator according to claim 1 wherein the groove type resonator includes a first groove type resonator and a second groove type resonator subsequently formed along the air introduction path, where the width of the first groove type resonator is smaller than that of the second groove type resonator and the height of the first groove type resonator is greater than that of the second groove type resonator.

* * * * *